United States Patent [19]

Uchida et al.

[11] 4,427,754

[45] Jan. 24, 1984

[54] ELECTROPHOTOGRAPHIC LITHOGRAPHIC PRINTING PLATE

[75] Inventors: Koji Uchida; Jun Yamada; Shigeyoshi Suzuki; Sadao Kuriu, all of Kyoto, Japan

[73] Assignee: Mitsubishi Paper Mills, Ltd., Tokyo, Japan

[21] Appl. No.: 354,799

[22] Filed: Mar. 4, 1982

[30] Foreign Application Priority Data

| | | | |
|---|---|---|---|
| Mar. 10, 1981 | [JP] | Japan | 56-34399 |
| Mar. 23, 1981 | [JP] | Japan | 56-42106 |
| May 12, 1981 | [JP] | Japan | 56-70990 |
| May 13, 1981 | [JP] | Japan | 56-70799 |
| Jul. 1, 1981 | [JP] | Japan | 56-102705 |
| Oct. 19, 1981 | [JP] | Japan | 56-166690 |

[51] Int. Cl.[3] ..... G03G 5/10; G03G 5/08; G03G 5/04

[52] U.S. Cl. ..... 430/60; 430/96; 430/49; 430/56

[58] Field of Search ..... 430/60, 56, 49, 96

[56] References Cited

U.S. PATENT DOCUMENTS

| | | | |
|---|---|---|---|
| 3,437,481 | 4/1969 | Graver et al. | 430/96 |
| 3,489,559 | 1/1970 | Clark et al. | 430/96 |
| 3,595,649 | 7/1971 | Shimizu et al. | 430/60 |
| 3,674,474 | 9/1972 | Kurokawa et al. | 430/60 |
| 4,120,720 | 10/1978 | Gross | 430/56 |
| 4,148,639 | 4/1979 | Sinkovitz et al. | 430/56 |
| 4,281,055 | 7/1981 | Moriguchi et al. | 430/56 |

FOREIGN PATENT DOCUMENTS

| | | | |
|---|---|---|---|
| 2037940 | 9/1969 | Fed. Rep. of Germany | 430/49 |
| 2721827 | 5/1976 | Fed. Rep. of Germany | 430/49 |
| 56-65148 | 10/1981 | Japan | 430/49 |

*Primary Examiner*—David A. Simmons
*Assistant Examiner*—Merrell C. Cashion
*Attorney, Agent, or Firm*—Cushman, Darby & Cushman

[57] ABSTRACT

There is disclosed an electrophotographic lithographic printing plate having a precoat layer having improved water resistance and organic solvent resistance and an improved photoconductive layer which comprises:

(1) a paper base;

(2) a precoat layer on one side of said paper base, which precoat layer contains at least
  (a) 10% by weight or less (based on total solids) of a film-forming water-soluble polymer,
  (b) about 30 to about 80% by weight (based on total solids content) of a water-dispersible resin, and
  (c) an inorganic pigment;

(3) a photoconductive layer provided on said precoat layer, which photoconductive layer contains
  (a) photoconductive zinc oxide, and
  (b) at least 2 binder resins different in acid value from each other by 5 or more, said mixed binder resins in the photoconductive layer having an average acid value of 5 to 30; and (4) a conductive back-coat layer on the other side of said paper base, which back-coat contains at least
  (a) 10% by weight or less (based on total solids) of a film-forming water-soluble polymer,
  (b) a water-dispersible resin, and
  (c) a conductive agent.

54 Claims, No Drawings

ELECTROPHOTOGRAPHIC LITHOGRAPHIC PRINTING PLATE

This invention relates to an electrophotographic lithographic printing plate and a method for preparing same.

Electrophotographic sensitive materials are generally composed of a base, which has been treated to become conductive, and, provided thereon, a photoconductive layer comprising a photoconductive substance and a binder. They can be utilized in making an offset printing plate after formation of an image on the photoconductive layer through the processing steps of charging, exposing, developing and fixing. Because of the simplicity and rapidity of the processing and of the low cost, the utilization of such a photosensitive material has become popularized in the field of light printing work.

The electrophotographic lithographic printing materials are required to possess properties necessary for both an electrophotographic duplicating material and a lithographic printing material. After image formation, the surface of photoconductive layer is wet with a special aqueous solution for surface treatment, i.e. an etching solution, to desensitize the non-image areas. In order to withstand this aqueous solution and a large quantity of a fountain solution used in lithographic printing, the lithograhic printing material is required to be highly resistant to water. In addition, the photoconductive layer should not be easily strippable from the paper base during the printing operation.

To meet the above requirements, it has heretofore been proposed to apply to the conductive base a precoat layer upon which the photoconductive layer is subsequently formed. Such a precoat layer is required to have the above-said essential properties such as sufficient water resistance and, in addition, to be sufficiently resistant to organic solvents, because the coating composition used in forming the photoconductive layer usually contains aromatic hydrocarbon solvents to disperse the photoconductive substance in a binder resin. Thus, the precoat layer is required to be resistant to both water and organic solvents; and it is desirable that both the water resistance and the solvent resistance be at a high level. However, since these resistances are generally contradictory to each other, none of the proposed precoat layers has fullfilled the requirements. The ill-balanced or insufficient water resistance and solvent resistance of the precoat layer lead to a defective electrophotographic lithographic printing plate, thus presenting one of the most difficult problems to the concerned technical people.

Japanese Patent Publication No. 18,708/65 disclosed that both the water resistance and the solvent resistance of the precoat layer are improved by the use of a film-forming water-soluble resin having a reactive hydroxyl or carboxyl group, which has been insolubilized through crosslinking with an aminoplast in an early condensation stage, such as dimehylolmelamine, dimethyltrimethylolmelamine or urea-formaldehyde. In spite of the disclosure of the results of subsequent development and proposals on the useful methods of crosslinking, the present inventors found that although effective in rendering the precoat layer insoluble in water, the crosslinking does not sufficiently prevent; the precoat layer from penetration of water and swelling. The insufficient water resistance permits an etching solution or fountain solution to penetrate through the precoat layer into the paper base, resulting in serious defects such as creasing of the printing plate and detachment of the photoconductive layer from the base during printing. The insufficient solvent resistance results in such defects as formation of cracks and pinholes in the surface layer of printing plate, which make the printing plate useless.

An object of this invention, therefore, is to provide an electrophotographic lithographic printing plate comprising a paper base as the conductive base and, disposed thereon, a precoat layer having improved water resistance and organic solvent resistance.

Another object of this invention is to provide an electrophotographic lithographic printing plate having an improved photoconductive layer disposed over said precoat layer.

In general, the adhesion between a substrate and a photoconductive layer formed by coating a dispersion of a mixture of granular inorganic photoconductive substance such as zinc oxide and a binder resin in an orgaic solvent depends primarily upon the mixing ratio of the granular substance to the resin. A higher resin proportion results in a stronger adhesion which is desirable for preventing the photoconductive layer from coming off the substrate, despite the influence of fountain solution employed in printing. It is difficult, however, to substantially increase the resin proportion, because if each particle of a photoconductive substance such as zinc oxide in the photoconductive layer exists independently without contacting with one another in a highly insulating resin, the lithographic printing material will not manifest satisfactory electrophotographic characteristics. A high proportion of a photoconductive substance is favorable for the increase in sensitivity, but tends to decrease the adhesion of the photoconductive layer. In addition, with the decrease in the ratio of resin to photoconductive particles, the ink receptivity tends to decrease undesirably as a result of the decrease of the image density under high humidity conditions.

The adherence of the photoconductive layer is one of the major factors affecting the printing endurance of a lithographic printing plate, as is also the case with the water resistance. A high printing endurance and the freedom from scumming are also important conditions for a lithograhic printing plate. In addition to that, the electrophotographic lithographic printing plate, similar to common electrophotographic copying materials, should be of high sensitivity, free from susceptibility to fogging, and exhibit desirable electrophotographic characteristics under widely variable temperature and humidity conditions. For instance, the density and evenness of an image tend to decrease under high humidity conditions, while under low humidity conditions fogging tends to occur and cause scumming. However, the fact is such that the attempts to improve electrophotographic characteristics frequently accompany deterioration of printing characteristics.

It would be valuable, therefore, if it is possible to obtain an electrophotographic lithographic printing plate have both required printing characteristics and electrophotographic characteristics by employing a photoconductive layer comprising 10 to 30 parts by weight of a binder resin for 100 parts by weight of photoconductive particles. The primary object of this invention is to provide such an electrophotographic lithographic printing plate or a process for making same.

The present inventors were engaged for many years in the studies to develop an electrophotographic lithographic printing material with required performance characteristics described above. As a result, they have succeeded in developing an electrophotographic lithographic printing material superior in both printing characteristics and electrophotographic characteristics to any of the currently available ones of similar structure.

The present electrophotographic lithographic printing material is characterized by being essentially composed of an electroconductive paper base; a precoat layer provided thereon and containing at least (a) 10% by weight or less (based on total solids) of a film-forming water-soluble polymer and (b) a water-dispersible resin; and a photoconductive layer disposed over said precoat layer and containing at least (a) an inorganic photoconductive substance and (b) two or more binder resins having different acid values, the average acid value of the mixed binder resin being 5 to 30.

More specifically, the present electrophotographic lithographic printing plate comprises (1) a paper base;

(2) a precoat layer on one side of said paper base, which precoat layer contains at least (a) 10% by weight or less (based on total solids) of a film-forming water-soluble polymer, (b) about 30 to about 80% by weight (based on total solids) of a water-dispersible resin, and (c) an inorganic pigment;

(3) a photoconductive layer provided on said precoat layer, which photoconductive layer contains (a) photoconductive zinc oxide, and (b) at least 2 binder resins different in acid value from each other by 5 or more, the binder resin mixture having an average acid value of 5 to 30; and (4) a conductive back-coat layer on the other side of said paper base, which back-coat layer contains at least (a) 10% by weight or less (based on total solids) of a film-forming water-soluble polymer, (b) a water-dispersible resin, and (c) a conductive agent.

The details of the invention and the preferred embodiments of it are described below.

As the film-forming water-soluble polymers to be used in the precoat layer, mention may be made of water soluble polymers having a carboxyl, hydroxyl, amino, imino group, etc., such as, for example, starch or derivative thereof, cellulose derivatives, e.g. carboxymethylcellulose and hydroxyethylcellulose; gelatin, casein, polyvinyl alcohol, and styrene-maleic anhydride copolymers. It is also possible, as described previously, to make these water-soluble resin insoluble after application of the precoating by incorporating a crosslinking agent in the coating composition. Of the water-soluble resins cited above, polyvinyl alcohol is especially preferred. The amount of a water-soluble polymer should be 10% or less, preferably about 2 to about 8% by weight based on the total solids of the precoat layer. By reducing the amount of water-soluble polymer, an advantage of omitting the crosslinking agent from the coating composition can also be gained.

The aqueous dispersions of water-dispersible resins used in the precoating are those obtained by emulsion polymerization or copolymerization of vinyl monomers such as, for example, acrylic acid or its esters, methacrylic acid or its esters, vinyl chloride, vinylidene chloride, vinyl acetate, acrylonitrile, butadiene, and styrene. An aqueous dispersion of a particularly preferred viny synthetic resin is that of a styrene copolymer and is usually prepared by the emulsion copolymerization of styrene with one or more suitable vinyl monomers such as, for example, acrylic esters, $\alpha$-substituted acrylic esters (e.g. methyl methacrylate and butyl methacrylate), acrylamide, vinyl halides (e.g. vinyl chloride), ethylene, propylene, butylene, butadiene, and acrylonitrile. The styrene monomers include substituted styrenes such as, for example, methylstyrene, hydroxystyrene and chlorostyrene. Particularly preferred styrene copolymers are those modified by introducing carboxyl groups such as carboxyl-containing styrene-butadiene copolymers obtained by the copolymerization with about 20 mole-% or less of an unsaturated carboxylic acid such as itaconic acid, acrylic acid or methacrylic acid. Such a copolymer is used also in aqueous dispersion (latex) form. The styrene component content of the styrene copolymer may be any, but is preferably about 25 to about 50 mole-%.

A desirable result is obtained by using the above aqueous dispersion of styrene copolymers in combination with an aqueous dispersion of styrene homopolymers. The styrene homopolymers are used either in the form of latex obtained by the emulsion polymerization of above-noted styrene monomers or in the form of fine aqueous dispersion of powdered polystyrene resembling a pigment.

The water-dispersible resin is used in an amount of about 25% by weight or more, preferably about 30 to about 80% by weight based on total solids of the precoat layer. To obtain a desirable result, the water-dispersible resin is used in an amount of at least 5 times, preferably at least 8 times the weight of aforementioned water-soluble resin. The precoat composition is admixed with inorganic pigments to improve the surface smoothness and to prevent blocking, and, if necessary, dispersants for the pigments, anti-foamers, or the like.

The inorganic pigment used in this invention is selected from the known inorganic pigments including carbonates of calcium, barium and lead, oxides of titanium, silicon and lead, hydroxides of aluminum and zinc, sulfates of zinc, calcium, barium and lead, silicates of silicon and aluminum, and sulfides of barium, calcium and zinc.

The inorganic pigment to be used in the precoating should have a water absorptiveness of 60% or less, preferably 50% or less. If a pigment having a water absorptiveness of more than 60% is used, the precoat layer, which even satisfies other requirements, tends to absorb large amounts of water from the etching solution and fountain solution, resulting in creasing and layer separation.

The water absorptiveness varies among pigments of the same or different type. The water absorptiveness, as herein defined, is a value determined by a method similar to the method of oil absorptiveness test specified in JIS K 5101. The test procedure is the same as that of JIS K 5101, except that water is used in place of the boiled linseed oil. The water absorption (water absorptiveness) is calculated by the following equation from the volume of water added till the end point when the adhered water has been detected by the touch of a finger tip:

$$\text{Water absorptiveness (\%)} = \frac{H}{P} \times 100$$

where

H: Volume of water used, ml.

P: Quantity of pigment used, g.

In order to obtain a smooth surface without defects such as cracks and pinholes after application of the photoconductive coating, it is desirable that the proportion of an inorganic pigment in the precoating be about 20 to about 60% by weight based on the total solids. The precoating is applied at a rate of about 3 to about 30 $g/m^2$, preferably 5 to 20 $g/m^2$ on dry basis. The coating is then dried. Before applying a photoconductive layer, it is desirable to subject the precoat layer to a surface-smoothing treatment such as super calendering.

By applying a precoating according to this invention, it becomes possible to obtain an electrophotographic lithographic printing plate excellent in water resistance and organic solvent resistance and, hence, excellent in dimensional stability and printing endurance. However, with the improvement in the quality as lithographic printing plate, there is apt to occur a decline in electrophotograhic characteristics, resulting in deterioration of the print quality. Further, as described previously, with the decrease in the ratio of a binder resin to photoconductive particles, the adhesion of the photoconductive layer to the precoat layer becomes insufficient and the image density will decrease under high humidity conditions so that the ink receptivity will also decrease. As one of the means to improve the density under high humidity conditions, it is desirable to use in the photoconductive layer a binder resin of high acid value. However, if a binder resin having an acid value (AV) of 40 or more is used alone in combination with particulate photoconductive substance, then the viscosity of the coating composition will become too high to be handled in practice, and the sensitizing dye becomes ineffective. On the other hand, a binder resin having a low acid value, e.g. 15 or less, does not substantially improve the defective characteristics under high humidity conditions, but is available in high molecular weight grade form which improves the film-forming property and adhesiveness of the photoconductive coating composition.

It was found by the present inventors that it is possible to obtain an electrophotographic lithographic printing plate containing a satisfactorily adhered photoconductive layer and exhibiting desirable characteristics even under high temperature and high humidity conditions, when the binder resin of said photoconductive layer is a mixture of at least 2 binder resins of different acid values in such a ratio that the average acid value of the mixture becomes 5 to 30, preferably 5 to 25, most preferably 10 to 20. A particularly good result is obtained by mixing at least one resin of an acid value smaller than 15 and at least one resin of an acid value of 15 or higher to form a mixed binder resin having an average acid value of 5 to 30.

The dispersion for forming the photoconductive layer according to this invention contains 10 to 40, preferably 10 to 30 parts by weight, of at least two binder resins of different acid values for 100 parts by weight of photoconductive particles such as zinc oxides, zinc sulfide and cadmium sulfide pigments. A preferred photoconductive material is zinc oxide. The binder resin may be combinations of at least two known resins such as acrylic resins, silicone resins and alkyd resins. The acid value of individual binder resin may be 0 to 40 or higher and at least two of them are combined to form a binder resin having an average acid value of 5 to 30. The resulting mixed binder resin preferably contains at least one combination of resins which differ in acid value from each other by at least 5, preferably 10 or more. As an example, mention may be made of a combination of one resin of an acid value of 10 or below, another resin of an acid value of 15 or above, and if necessary, a third resin of any acid value.

The "average acid value", as herein defined, can be calculated by summing up the products $a_1w_1$, $a_2w_2$, $a_3w_3$, etc., where $a_1$, $a_2$, $a_3$, etc. each represents the acid value of individual binder resin and $w_1$, $w_2$, $w_3$, etc. each represents the weight percent (based on the total weight of binder resins) of corresponding resin. The average acid value can be determined similarly to the determination of the acid value of each resin and approximately coincides with the calculated value. For instance, the average acid value of a mixture of equal weight of a resin having an acid value of 10 and another resin having an acid value of 20 will be 15.

It was found most suitable for the binder resin having an acid value of less than 15 or the binder resin having an acid value of 15 or more to use a copolymer produced from the following monomers (A), (B) and (C). Owing to its high desensitizability, such a resin imparts a high scumming resistance and a high printing endurance to the printing plate which is produced.

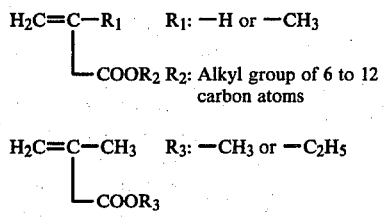

(A)

(B)

(C) A vinyl monomer having a carboxyl group and copolymerizable with monomers (A) and (B)

The monomer ratio is (A):(B):(C)=30–60:40–70:0.5–5 (% by weight) and the weight average molecular weight of the copolymer is 100,000 to 200,000. The monomer (A) is selected from esters of acrylic or methacrylic acid with an alcohol having 6 to 12 carbon atoms, such as cyclohexanol, n-hexanol, 2-ethylhexyl alcohol or lauryl alcohol. The monomer (B) is methyl or ethyl methacrylate. The monomer (C) is a carboxylic acid containing a vinyl group copolymerizable with monomers (A) and (B), such as acrylic acid, methacrylic acid, itaconic acid, maleic acid, fumaric acid, or crotonic acid. The monomer (C) content of the copolymer is 0.5 to 5, preferably 0.5 to 3% by weight based on the total weight of copolymer.

The above resin is particularly preferred for the binder resin but not limitative and other resins of any molecular weight may also be used. For instance, a resin of an acid value less than 15 and a resin of an acid value of 15 or more can be obtained by the copolymerization of at least one of acrylic esters or/and methacrylic esters with at least one of carboxylic acids having a vinyl group. As the alcohol moieties of said acrylic esters or methacrylic esters, mention may be made of methyl, ethyl, n-propyl, isopropyl, isobutyl, n-hexyl, cyclohexyl, 2-ethylhexyl, lauryl, stearyl, benzyl, 2-hydroxyethyl, hydroxypropyl, glycidyl, dimethylaminoethyl, and tert-butylaminoethyl groups, etc.

The best result is obtained when a binder resin of an acid value of 15 or above is prepared by interpolymerizing a styrene monomer with a copolymer of an acrylic ester or/and a methacrylic ester and a carboxylic acid having a vinyl group and the resulting interpolymer is used in combination with a binder resin of an acid value of less than 15, particularly the one prepared from the above-noted monomers (A), (B) and (C). The said styrene monomers include styrene, alkyl-substituted styrenes, halogen-substituted styrenes, alkoxy-substituted styrenes, hydroxyl-substituted styrenes and carboxyl-substituted styrenes, etc. The styrene inter polymer can be used also as a binder resin of an acid value of less than 15. Although the combination of binder resins to form a combined binder resin of an average acid value of 5 to 30 is subject to no limitation, it is desirable to combine a binder resin of an acid value less than 15 with another binder resin of an acid value of 15 or above in a weight ratio of from 2:8 to 8:2, preferably from 3:7 to 7:3.

The dispersion for forming the photoconductive layer is prepared in a manner similar to that of the conventional procedure. A particulate photoconductive substance such as zinc oxide, two or more binder resins different in acid value, an organic solvent such as toluene or xylene, and a sensitizing dye or other sensitizers such as Lewis acids are blended and milled in a ball mill, roller mill, sand mill, homomixer, homogenizer or oscilator mill to produce a dispersion. It was found that desirable electrophotographic characteristics, good adhesion to the precoat layer, and good ink receptivity are imparted to the printing plate by using a dispersion which shows a Bekk smoothness of about 1,000 to about 4,000 seconds when coated on a surface of a substantially infinite Bekk smoothness. The test can be easily performed by coating a sample of dispersion, in a customary manner, on a highly smooth surface such as that of a film or a metal (e.g. aluminum sheet) having a Bekk smoothness (JIS P8119) of from several tens of thousand to several hundred thousands, that is, substantially infinite value, and measuring the Bekk smoothness (JIS P8119) of the coated surface. The above-noted desirable dispersion is by increasing considerably but not excessively the fineness of dispersion. It was found that the fineness of the dispersion can be specified in terms of Bekk smoothness determined as described above.

The surface smoothness of the photoconductive layer formed by coating a super-calendered precoat layer with a photoconductive dispersion prepared in the customary manner has its own limit. Commercially available electrophotographic lithographic printing materials (precoated paper base) showed a Bekk smoothness of about 300 seconds at most. The Bekk smoothness of a photoconductive dispersion coated on a base varies with the type of base. For instance, a dispersion having a Bekk smoothness of about 1,000 to about 4,000 seconds, as tested by the procedure described above, shows generally a value of about 500 to 1,500 seconds when coated on a precoat layer provided on a paper base.

Although depending on the method of dispersing, a dispersion of desirable Bekk smoothness is obtained by increasing several-fold, generally 3- to 6-fold, the duration or the intensity of milling adapted to a conventional operation to produce a dispersion of Bekk smoothness of 300 seconds at most. It is also possible to use a dispersion produced by the conventional dispersing operation. However, when the binder resins of different acid values are so combined as to make the average acid value of the combined resin to 5 to 30 and the dispersion is made to have a desirable Bekk smoothness, then the properties characteristic of each binder resin may be fully exhibited to provide an electrophotographic lithographic printing material markedly improved in electrophotographic characteristics and printing characteristics.

In the present electrophotographic lithographic printing material, the paper base may be made electroconductive by providing a conductive backcoat layer on the back side. Like the precoat layer, the backcoat layer is required to be water resistant. A desirable backcoat layer comprises 10% by weight or less of a film-forming water-soluble polymer and a water-dispersible resin, as described above in connection with the precoat layer, and a conductive agent. A detailed description about its preparation is omitted here, because most of the description is similar to that already given in the case of precoat layer. However, the backcoat layer can be a coating layer of a water repellent such as wax.

Known conductive agents are used in the present backcoat layer. As examples of such agents, mention may be made of polymer-like electrolytes such as polyvinyltrimethylammonium chloride, polyvinylbenzyltrimethylammonium chloride, poly-4-vinylpyridine, poly-2-vinylpyridine, diethylaminoethyl polymethacrylate hydrochloride, di-2-ethylhexyl sulfosuccinate, sodium cetyl phosphate, sodium or ammonium polystyrenesulfonate, polyacrylate salts, and sodium salt of methyl vinyl ether-maleic anhydride copolymer and inorganic salts such as chlorides. The backcoat composition is applied in a customary manner at a rate of 3 to 30 $g/m^2$, preferably 5 to 20 $g/m^2$ on dry basis. The coating is then dried.

The paper base used in this invention is a wet-strength paper sheet made from a pulp suspension comprising common paper pulp (together with or without a small amount of synthetic fiber or synthetic resin) and internal additives including wet-strength agents such as thermosetting condensation resins, polyamide resins, starch and polyvinyl alcohol, sizing agents and fillers, or made by the method of size-pressing. A particularly preferred conductive paper support has a surface resistivity of $10^{11}$ Ω·cm or below (at 20° C., 60% RH), which is prepared by impregnating the paper stock with conductive agents, preferably hygroscopic inorganic salts such as chlorides, sulfates or phosphates of alkali metals or alkaline earth metals so as to distribute the salt throughout the structure of paper stock. Examples of the hygroscopic salts are magnesium chloride, calcium chloride, sodium chloride, strontium chloride, lithium chloride, molybdenum chloride, sodium sulfate, sodium hydrogensulfate, and sodium phosphate. Such an impregnated paper is a known material.

Generally, an electrophotographic lithographic printing material, which is provided with a precoat layer and photoconductive layer improved in wet strength and mechanical strengths and which is improved in dimensional stability and printing endurance, tends to become inferior in image characteristics and is subject to fogging and scumming especially under low humidity conditions. Such disadvantages are greatly ameliorated by the use of the above-noted paper base impregnated with an inorganic salt. In one of the embodiments of this invention, by using the impregnated paper base and by incorporating a small amount of conductive agent in the precoat layer, there is obtained a lithographic printing plate exhibiting desirable electrophotographic characteristics under humidity conditions varying in a wide range from low to high, yet without deterioration in printing characteristics.

The conductive agent is incorporated in the precoat layer in an amount sufficient to decrease the surface resistivity to $10^{10}$–$10^{11}$ Ω·cm, preferably $5\times10^{10}$–$10^{11}$ Ω·cm (at 20° C., 60% RH). Suitable conductive agents are those described before in connection with the backcoat layer. With the decrease in surface resistivity of the precoat layer beyond the above limit, the fog especially at low humidity is further reduced and the image quality is more improved, whereas the printing endurance becomes inferior. It was confirmed that in the case of the precoat layer of this invention, an image of high quality is obtained without any decline in printing endurance by using a small amount of conductive agent. By incorporating a conductive agent in the precoat layer and using a conductive paper base impregnated with an inorganic salt, it becomes possible to reduce relatively the amount of conductive agent in the backcoat layer, resulting in amelioration of the disadvantages originated from the water resistance of the backcoat layer. The amount of conductive agent to be added to the backcoat layer to make it conductive is not limited but can be about 5 to about 100 times the amount of conductive agent incorporated in the precoat layer, provided the conductive agent in both layers is the same compound.

The present electrophotographic lithographic printing material is especially suitable for wet development with a liquid toner. Conventional liquid toners or etching solutions may be used.

Commercial electrophotographic lithographic printing material for wet development will be found unsatisfactory with respect to scumming and printing endurance if evaluated strictly. When desensitized by means of an etching processor, they still show scumming in scattered tiny dots, though the scumming which spreads uniformly over the plate surface is reduced. The scumming in tiny dots might be overlooked in the case of common original but become noticeable in the case of an original of large non-image areas. Such scumming in tiny dots might be mistaken for decimal points or they might fill up the halftone dots and injure the print quality has been known that a lithographic printing plate can be relieved of the scumming by treating again in an etching processor the once treated plate, that is, double treatment. The double treatment is known also effective for the relief of dotted scumming and is often adopted when the dotted scumming is judged to be detrimental to the print quality. However, except for the cases where the etching processor can be operated independently to permit the double treatment, the double treatment is practically difficult to carry out in the automated systems of printing plate making and printing, which are now being popularized and in which the plate making machine and etching processor, or etching processor and printing machine, or plate making machine and etching processor and printing machine are unified into an integral unit. The present lithographic printing plate, which is provided with a photoconductive layer described above in detail, is imparted with both the improved printing endurance and the excellent desensitizability which makes the plate free from not only the scumming which spreads all over the plate face but also the dotted scumming by single treatment in etching processor.

The invention is further illustrated below with reference to Examples of preferred embodiments, but the invention is not limited thereto.

EXAMPLE 1

The following coating composition for forming a precoat layer was applied at a rate of 7 g/m$^2$ on dry basis on one side (right side) of a paper base, 130 g/m$^2$ in basis weight, having a surface resistivity of $6\times10^{10}$ Ω·cm (20° C., 60% RH), which had been made from a soft wood pulp as major material and tub-sized (impregnated) with an aqueous sodium chloride solution. The coated base was dried and super-calendered. The surface resistivity of the precoat layer was $5\times10^{10}$ Ω·cm (20° C., 60% RH).

| Coating composition for precoat layer: | Parts by weight |
|---|---|
| Kaolin clay (50% by weight aqueous dispersion; water absorptiveness, 35.5%) | 200 |
| Fine granular polystyrene (average particle size, 0.5μ; 48.5% by weight aqueous dispersion) | 150 |
| Polyvinyl alcohol (10% aqueous solution) | 150 |
| Carboxyl-modified styrene-butadiene copolymer (SBR) emulsion (45% solids content) | 150 |
| Polyvinylbenzyltrimethylammonium chloride (34% aqueous solution; ECR 34, trade name, Dow Chemical Co.) | 5 |

The paper base was then coated on the opposite side (wrong side) with the following coating composition for forming a backcoat layer at a rate of 13 g/m$^2$ on dry basis and dried.

| Coating composition for backcoat layer: | Parts by weight |
|---|---|
| Kaolin clay (50% by weight aqueous dispersion; water absorptiveness, 35.5%) | 300 |
| Polyvinyl alcohol (10% aqueous solution) | 40 |
| Carboxyl-modified SBR copolymer emulsion (45% solids content) | 200 |
| ECR 34 | 40 |

The following resins A, B and C were used as binder resins for the photoconductive layer:

A: 3-Component copolymer of n-hexyl methacrylate, ethyl methacrylate and methacrylic acid; acid value, 9; weight average molecular weight, about 130,000.
B: 3-Component copolymer of styrene, butyl methacrylate and methacrylic acid; acid value, 14.
C: 3-Component copolymer of styrene, ethyl acrylate and acrylic acid; acid value, 37.

The following coating composition for forming photoconductive layer was prepared by using the above resins and milling in a ball mill for 24 hours to form a dispersion. The coating composition was applied over the precoat layer at a rate of 25 g/m$^2$ on dry basis and dried.

| Coating composition for photoconductive layer: | Parts by weight |
|---|---|
| Zinc oxide | 200 |
| Resin A (50% solids content) | 50 |
| Resin B (50% solids content) | 15 |
| Resin C (50% solids content) | 15 |

-continued

| Coating composition for photoconductive layer: | Parts by weight |
|---|---|
| Rose Bengal (2% methanol solution) | 8 |
| Xylene | 200 |

The Bekk smoothness of the photoconductive layer surface was 915 seconds and that of a polyester film base coated with the same coating composition was 2,064 seconds.

The printing plate material thus prepared was seasoned and dark adapted for 24 hours in a darkroom adjusted to 25° C. and 60% RH. Thereafter, the printing plate material was processed by means of a wet developing-type electrophotographic printing plate making apparatus (Diafax Master EP-11 of Mitsubishi Paper Mills Co.). On inspection, the printing plate was found free from the distortion of the coating layer caused by squeezing rolls and free from fogging. The image was sharp. The printing plate was then desensitized by subjecting to single treatment with an etching solution (LOM-OH of Mitsubishi Paper Mills Co.) by means of Etching Converter OH-11 (Mitsubishi Paper Mills Co.). The printing test was performed by means of an offset press (Toko Model 810; Tokyo Koku Keiki Co.) and 5,000 copies were printed. The print quality was excellent, none of the defects such as layer stripping and image loss, stains due to the uniform scumming all over the printing plate or dotted scumming having been observed.

COMPARATIVE EXAMPLE 1

A lithographic printing plate material was prepared in the same manner as in Example 1, except that the resin A was used in place of the resins B and C in the photoconductive layer. When processed under high humidity conditions such as, for example, 80% RH at 25° C., the printing plate showed a low image density and an inferior ink receptivity.

COMPARATIVE EXAMPLE 2

A lithographic printing plate material was prepared in the same manner as in Example 1 except that the resin C was used in place of the resins A and B in the photoconductive layer. The viscosity of the coating liquid for photoconductive layer increased with lapse of time and the coat surface showed coating unevenness. The sensitivity of this lithographic printing plate was lower than that of Example 1.

COMPARATIVE EXAMPLE 3

A lithographic printing plate material was prepared in the same manner as in Example 1, except that the polyvinyl alcohol content of the precoat layer was increased to 12% by weight. Before 3,000 copies had been printed, creasing and scumming appeared on the printing plate, indicating insufficient water resistance.

EXAMPLE 2

A lithographic printing plate was prepared in the same manner as in Example 1, except that the photoconductive layer was formed from the coating composition of the following composition containing the resin B and the following resin D. The Bekk smoothness was 630 seconds.

D: 3-Component copolymer of lauryl methacrylate, methyl methacrylate and itaconic acid; acid value, 22; weight average molecular weight, about 120,000.

| Coating composition for photoconductive layer: | Parts by weight |
|---|---|
| Zinc oxide | 200 |
| Resin B (50% solids content) | 50 |
| Resin D (50% solids content) | 30 |
| Rose Benzal (2% methanol solution) | 10 |
| Toluene | 200 |

The results obtained were similar to those of Example 1.

EXAMPLE 3

The following coating composition for forming an electroconductive layer was applied at a rate of 13 g/m$^2$ on dry basis on one side (wrong side) of a paper base made from soft wood pulp as major material. The coating was then dried.

| Coating composition for forming conductive layer: | Parts by weight |
|---|---|
| Kaolin clay (50% by weight aqueous dispersion; water absorptiveness, 35.5%) | 600 |
| Polyvinyl alcohol (10% aqueous solution) | 200 |
| SBR latex (50% solids content) | 450 |
| Polyvinyl benzyltrimethylammonium chloride (ECR 34; solids content, 30%) | 200 |
| Melamine-formaldehyde early-stage condensate (80% solids content; Sumirez resin-613 of Sumitomo Chemical Co.) | 15 |

The following coating composition for forming a precoat layer was applied to the opposite side (right side) of the paper base at a rate of 9 g/m$^2$ on dry basis and the coating was then dried at 100° C. The resulting precoat layer (surface resistivity: $7\times10$ Ω·cm at 20° C. and 60% RH) was super-calendered. A photoconductive layer was provided on the paper-calendered surface.

| Coating composition for forming precoat layer: | Parts by weight |
|---|---|
| Kaolin clay (50% aqueous dispersion; water absorptiveness 35.5%) | 200 |
| Fine granular polystyrene (average particle size, 0.5μ; 48.5% aqueous dispersion) | 150 |
| Polyvinyl alcohol (10% aqueous solution) | 200 |
| SBR latex (50% solids content) | 150 |
| Sumirez resin-613 | 15 |
| Ammonium polystyrenesulfonate (30% aqueous solution) | 6 |

The photoconductive layer was formed by coating the following coating composition for forming photoconductive layer at a rate of 20 g/m$^2$ and drying the coating at 100° C.

| Coating composition for forming photoconductive layer: | Parts by weight |
|---|---|
| Zinc oxide | 200 |
| Resin A (50% solids content) | 40 |
| Resin B (50% solids content) | 20 |
| Resin C (50% solids content) | 20 |
| Resin D (50% solids content) | 20 |
| Rose Bengal (2% methanol solution) | 10 |

-continued

| Coating composition for forming photoconductive layer: | Parts by weight |
|---|---|
| Xylene | 250 |
| Isopropanol | 10 |

Results obtained were similar to those of Example 1.

EXAMPLE 4

A lithographic printing plate was prepared in the same manner as in Example 3, except that the following coating composition for precoat layer was employed:

| Coating composition for forming precoat layer: | Parts by weight |
|---|---|
| Kaolin clay (50% aqueous suspension) | 300 |
| Fine granular polystyrene (average particle size, 0.5μ; 48.5% aqueous dispersion) | 150 |
| Polyvinyl alcohol (10% aqueous solution) | 300 |
| Carboxyl-modified SBR latex (50% solids content; commercial grade) | 150 |

As compared with printing plates prepared in Example 1 to 3, the printing plate obtained above was somewhat inferior in photographic characteristics under low humidity conditions and in water resistance, but was superior to the conventional printing plates.

EXAMPLE 5

A lithographic printing plate was prepared in the same manner as in Example 1, except that the following coating composition was employed in forming the precoat layer:

| Coating composition for precoat layer: | Parts by weight |
|---|---|
| Kaolin clay (50% by weight aqueous dispersion) | 200 |
| Carboxyl-modified SBR latex (50% solids content; commercial grade) | 150 |
| Acrylate ester emulsion (45% solids content; commercial grade) | 150 |
| Hydroxyethylcellulose (10% aqueous solution) | 50 |
| Carboxymethylcellulose (10% aqueous solution) | 50 |

Results obtained were similar to those of Example 1.

EXAMPLE 6

A lithographic printing plate was prepared in the same manner as in Example 1, except that n-hexyl methacrylate-methacrylic acid copolymer (acid value, 6) was used in place of the resin A used in the photoconductive layer.

Results obtained were similar to those of Example 1.

What is claimed is:

1. An electrophotographic lithographic printing plate comprising
   (1) a paper base;
   (2) a precoat layer on one side of said paper base, which precoat layer contains at least
      (a) 10% by weight or less (based on total solids) of a film-forming water-soluble polymer,
      (b) about 30 to about 80% by weight (based on total solids) of a water-dispersible resin, and
      (c) an inorganic pigment;
   (3) a photoconductive layer provided on said precoat layer, which photoconductive layer contains
      (a) photoconductive zinc oxide, and
      (b) at least 2 binder resins different in acid value from each other by 5 or more, said binder resin mixture having an average acid value of 5 to 30; and
   (4) a conductive back-coat layer on the other side of said paper base, which back-coat layer contains at least
      (a) 10% by weight or less (based on total solids) of a film-forming water-soluble polymer,
      (b) a water-dispersible resin, and
      (c) a conductive agent.

2. A printing plate according to claim 1, wherein the amount of the water-soluble polymer in the precoat layer is about 2 to about 8% by weight.

3. A printing plate according to claim 1, wherein the water-soluble polymer is polyvinyl alcohol.

4. A printing plate according to claim 1, wherein the water-dispersible resin is a vinyl-type synthetic resin in emulsion form.

5. A printing plate according to claim 4, wherein the vinyl-type synthetic resin is a copolymer containing a styrene component.

6. A printing plate according to claim 5, wherein the copolymer containing a styrene component further contains about 20 mole-% or less of an unsaturated carboxylic acid copolymerized therewith.

7. A printing plate according to claim 5, wherein a water dispersion of polystyrene is additionally used.

8. A printing plate according to claim 1, wherein the amount of inorganic pigment in the precoat layer is about 20 to about 60% by weight based on total solids.

9. A printing plate according to claim 8, wherein the inorganic pigment in the precoat and backcoat layers has a water absorptiveness of 60% or below.

10. A printing plate according to claim 1, wherein the binder resin mixture of the photoconductive layer has an average acid value of 5 to 25.

11. A printing plate according to claim 1, wherein the binder resin mixture of the photoconductive layer has an average acid value of 10 to 20.

12. A printing plate according to claim 1, 10 or 11, wherein at least one of the binder resins in the photoconductive layer has an acid value below 15 and at least one of the other binder resins in the same layer has an acid value of 15 or above.

13. A printing plate according to claim 1, wherein at least one of the binder resins in the photoconductive layer is a copolymer formed from the monomers (A)

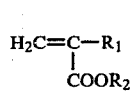

(where $R_1$ is —H or —$CH_3$ and $R_2$ is an alkyl group of 6–12 carbon atoms), (B)

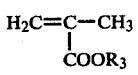

(where $R_3$ is —$CH_3$ or —$C_2H_5$) and (C) a vinyl monomer having a carboxyl group and copolymerizable with monomers (A) and (B), the weight average molecular weights of the copolymer being 100,000 to 200,000.

14. A printing plate according to claim 13, wherein the proportion of the vinyl monomer having a carboxyl group (C) in the copolymer is 0.5 to 3% by weight.

15. A printing plate according to claim 1, wherein at least one of the binder resins in the photoconductive layer is a copolymer of a styrene component, an acrylate ester or/and a methacrylate ester component, and a vinyl monomer having a carboxyl group.

16. A printing plate according to claim 1, wherein the weight ratio of photoconductive zinc oxide to the binder resin is 100:10–30.

17. A printing plate according to claim 1, wherein the precoat layer contains no crosslinking agent for the water-soluble resin.

18. An electrophotographic lithographic printing plate comprising (1) a paper base impregnated with a hygroscopic inorganic salt;

(2) a precoat layer on one side of said paper base, which precoat layer contains at least
  (a) 10% by weight or less (based on total) of a film-forming water-soluble resin,
  (b) about 30 to about 80% by weight (based on total) of a water-dispersible resin, and
  (c) an inorganic pigment;

(3) a photoconductive layer provided on said precoat layer, which photoconductive layer contains
  (a) photoconductive zinc oxide, and
  (b) at least 2 binder resins different in acid value from each other by 5 or more, the binder resin mixture having an average acid value of 5 to 30; and (4) a conductive back-coat layer on the other side of said paper base, which back-coat layer contains at least
  (a) 10% by weight or less (based on total) of a film-forming water-soluble polymer,
  (b) a water-dispersible resin, and
  (c) a conductive agent.

19. A printing plate according to claim 18, wherein the precoat layer contains a conductive agent in an amount sufficient to bring the surface resistivity of the precoat layer to $10^{10}$ to $10^{11}$ Ω·cm at 20° C. and 60% RH.

20. A printing plate according to claim 18, wherein the amount (in weight) of the water-dispersible resin (b) in the precoat layer is at least 5 times the weight of the water-soluble resin (a).

21. A printing plate according to claim 18, wherein the amount (in weight) of the water-dispersible resin (b) in the backcoat layer is at least 5 times the weight of the film-forming water-soluble polymer (a).

22. A printing plate according to claim 18, wherein the amount of the water-soluble resin in the precoat layer is about 2 to about 8% by weight.

23. A printing plate according to claim 18, wherein the amount of the inorganic pigment in the precoat layer is about 20 to about 60% by weight based on the total solids.

24. A printing plate according to claim 18, wherein the inorganic pigment in the precoat layer and backcoat layer has a water absorptiveness of 60% or less.

25. A printing plate according to claim 18, wherein the water-soluble resin in the precoat layer is a polymer having at least a carboxyl group, hydroxyl group, amino group or imino group.

26. A printing plate according to claim 18, wherein the water-soluble resin in the precoat layer is polyvinyl alcohol.

27. A printing plate according to claim 18, wherein the water-dispersible resin in the precoat layer is a copolymer containing a styrene component.

28. A printing plate according to claim 27, wherein the water-dispersible resin in the precoat layer is a copolymer containing at least a styrene component and about 20 mole-% or less of an unsaturated carboxylic acid component.

29. A printing plate according to claim 27, wherein water dispersion of polystyrene is used additionally.

30. A printing plate according to claim 18, wherein the binder resin mixture in the photoconductive layer has an average acid value of 5 to 25.

31. A printing plate according to claim 18, wherein the binder resin mixture in the photoconductive layer has an average acid value of 10 to 20.

32. A printing plate according to claim 18, 30 or 31, wherein at least one of the binder resins in the photoconductive layer has an acid value below 15 and at least one of the binder resins has an acid value of 15 or above.

33. A printing plate according to claim 18, wherein at least one of the binder resins in the photoconductive layer is a copolymer formed from the monomers (A)

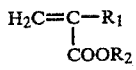

(where $R_1$ is —H or —$CH_3$ and $R_2$ is an alkyl group of 6–12 carbon atoms), (B)

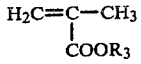

(where $R_3$ is —$CH_3$ or —$C_2H_5$) and (C) a vinyl monomer having a carboxyl group and copolymerizable with monomers (A) and (B), the weight average molecular weight of the copolymer being 100,000 to 200,000.

34. A printing plate according to claim 33, wherein the copolymer contains 0.5 to 3% by weight of the vinyl monomer having a carboxyl group.

35. A printing plate according to claim 18, wherein at least one of the binder resins in the photoconductive layer is a copolymer of a styrene component, an acrylate ester or/and a methacrylate ester component, and a vinyl monomer having a carboxyl group.

36. A printing plate according to claim 18, wherein the weight ratio of photoconductive zinc oxide to the binder resin is 100:10–30.

37. An electrophotographic lithographic printing plate composed of a condutive base, a precoat layer provided on said conductive base, and a photoconductive layer laid over said precoat layer, wherein said base is a paper base; said precoat layer contains at least (a) 10% by weight or less (based on total solids) of a film-forming water-soluble polymer and (b) a water-dispersible resin; and said photoconductive layer contains at least (a) inorganic photoconductive particles and (b) 2 or more binder resins different in acid value from each other, the average acid value of the binder resin mixture being 5 to 30.

38. A printing plate according to claim 37, wherein the amount of the water-soluble polymer in the precoat layer is about 2 to about 8% by weight.

39. A printing plate according to claim 37, wherein the water-soluble resin in the precoat layer is a polymer having at least a carboxyl group, hydroxyl group, amino group or imino group.

40. A printing plate according to claim 39, wherein the water-soluble resin in the precoat layer is polyvinyl alcohol.

41. A printing plate according to claim 37, wherein the water-dispersible resin is a vinyl-type synthetic resin in emulsion form.

42. A printing plate according to claim 41, wherein the vinyl-type synthetic resin is a copolymer containing a styrene component.

43. A printing plate according to claim 42, wherein the copolymer containing a styrene component further contains about 20 mole-% or less of an unsaturated carboxylic acid copolymerized therewith.

44. A printing plate according to claim 42, wherein a water dispersion of polystyrene is additionally used.

45. A printing plate according to claim 37, wherein the photoconductive layer contains at least 2 binder resins different from each other in acid value by 5 or more.

46. A printing plate according to claim 37, wherein the binder resin mixture in the photoconductive layer has an average acid value of 5 to 25.

47. A printing plate according to claim 37, wherein the binder resin mixture in the photoconductive layer has an average acid value of 10 to 20.

48. A printing plate according to claim 45, wherein at least one of the binder resins in the photoconductive layer has an acid value below 15 and at least one of the other binder resins in the same layer has an acid value of 15 or above.

49. A printing plate according to claim 37, wherein at least one of the binder resins in the photoconductive layer is a copolymer formed from the monomers (A)

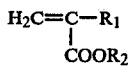

(wherein $R_1$ is —H or —$CH_3$ and $R_2$ is an alkyl group of 6–12 carbon atoms), (B)

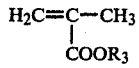

(where $R_3$ is —$CH_3$ or —$C_2H_5$) and (C) a vinyl monomer having a carboxyl group and copolymerizable with monomers (A) and (B), the weight average molecular weight of the copolymer being 100,000 to 200,000.

50. A printing plate according to claim 49, wherein the copolymer contains 0.5 to 3% by weight of the unit of the vinyl monomer having a carboxyl group (C).

51. A printing plate according to claim 37, wherein at least one of the binder resins in the photoconductive layer is a copolymer of a styrene component, an acrylate ester or/and a methacrylate ester component, and a vinyl monomer having a carboxyl group.

52. A method for preparing an electrophotographic lithographic printing plate, which comprises coating one side of a paper base with a coating composition containing at least (a) 10% by weight or less (based on total solids) of a film-forming water-soluble polymer and (b) a water-dispersible resin, then drying the coating to form a precoat layer; applying to said precoat layer a coating composition as a photoconductive layer obtained by dispersing in a medium a mixture comprising at least (a) an inorganic photoconductive particles and (b) 2 or more binder resins different from each other in acid value, the average acid value of the resin binder mixture being 5 to 30, so that the Bekk smoothness of the dispersion becomes about 500 to about 1,500 seconds (as determined by the method specified in JIS P 8119), and drying the coating to form a photoconductive layer.

53. A method according to claim 52, wherein the inorganic photoconductive particles are zinc oxide particles.

54. A method for plate-making, which comprises subjecting the electrophotoconductive lithographic printing plate according to claim 1 to corona-charging, imagewise-exposing and subsequent developing with a liquid developer to form images.

* * * * *